United States Patent [19]

Lederrey

[11] Patent Number: 4,473,306

[45] Date of Patent: Sep. 25, 1984

[54] WRISTWATCH CASE

[75] Inventor: Marc Lederrey, Ipsach, Switzerland

[73] Assignee: Montres Rado S.A., Longeau, Switzerland

[21] Appl. No.: 499,229

[22] Filed: May 31, 1983

[30] Foreign Application Priority Data

Jun. 10, 1982 [CH] Switzerland ..... 3583/82

[51] Int. Cl.[3] ..... G04B 37/00

[52] U.S. Cl. ..... 368/296; 368/294; 368/285

[58] Field of Search ..... 368/291, 294, 296, 276

[56] References Cited

U.S. PATENT DOCUMENTS

| | | | |
|---|---|---|---|
| 4,327,429 | 4/1982 | Klingenberg | 368/294 |
| 4,391,533 | 7/1983 | Waki | 368/276 |
| 4,421,423 | 12/1983 | Lederrey | 368/291 |

FOREIGN PATENT DOCUMENTS

| | | | |
|---|---|---|---|
| 2823204 | 12/1978 | Fed. Rep. of Germany | 368/296 |

*Primary Examiner*—Bernard Roskoski

*Attorney, Agent, or Firm*—Peter L. Berger

[57] ABSTRACT

A crystal (1) of a wristwatch case contains a sapphire base plate (2) which, in front view, entirely covers the body (3) of the case. That plate (2) is in turn entirely covered by a second sapphire plate (4) which is glued (5) to plate (2) very rigidly. The crystal (1) is fastened to the body (3) by screws engaged from the back side of the body (3) in sockets (7), a head (9) of which is captured between the two plates (2, 4) of the crystal (1). The position of the sockets (7) is exactly determined by a conical seat (10) of housings hollowed out in plate (2), at the bottom of which rests the conical head (9) of the sockets (7). Flats (14) are formed on the heads (9), so that the glue forms packings (15) preventing the sockets (7) from turning while screwing the crystal (1). The upper face (6) of the square (3) and the heads (9) of the sockets (7) are masked by a metal coating (12) deposited by vacuum spraying on the other side of plate (4). The crystal (1) is, furthermore, decorated with semicylindrical colored sapphire baguettes (16) glued in corresponding grooves (19) of plate (4).

9 Claims, 6 Drawing Figures

WRISTWATCH CASE

BACKGROUND OF THE INVENTION

Watchcases having their top formed of a flat sapphire crystal to mask the body of the bases were proposed in Swiss patent application 2859/81. In those cases, the sockets enabling the crystal to be attached to the watch body are integrated with the crystal by means of a frame glued under the crystal.

An object of this invention, among others, is to simplify that construction without sacrificing the possibilities of decorating the case, and even increasing the strength of the crystal.

By embedding the head of the socket in the crystal itself, it is no longer necessary to fasten a frame under the crystal. Furthermore, by using two sapphire plates glued to each other, the crystal is stronger than if it were made of one piece. In addition, the two sapphire plates glued to each other provide the same possibilities of decorating the case as offered by the frame glued under the crystal.

The cones formed in the base plate of the crystal and the conical heads of the crystal fastening sockets enable the sockets to be perfectly centered by placing the heads in their respective conical seats. The pressure exerted on the base plate of the crystal is not dangerous. If, by chance, a break or crack of that base plate should occur, a piece of the latter could not come loose; it would remain glued, in fact, to the sapphire plate glued to the base plate.

The two plates comprising the crystal have the same shape. Since these two plates are glued directly to each other in the entire transparent part of the crystal, it is unnessary to be greatly concerned about the adherence of the metal coating formed on the other side of the glued plate of the crystal. Thus wholly captured between two sapphire plates, this coating is completely inaccessible; it is perfectly sheltered from all contact with foreign bodies. Barring destruction of the crystal, nothing can then alter it.

Decorative elements can also be provided in the external face of the crystal, as long as their hardness protects them from damage.

Although a sapphire plate with a simply ground face is not transparent, but only translucent, the glue has the effect of filling the fine grinding striations, so that the set of two sapphire plates glued to each other becomes perfectly transparent. The costly operation of polishing one of the faces of the two sapphire plates is thus avoided. Furthermore, such a crystal is anti-reflecting. It is then no longer necessary to subject the face of the dial to special treatment intended to make it dull. Finally, this crystal makes it possible to produce, as desired, dull or bright metal coatings, on the other side of the glued plate, depending on whether the simply ground face in question is the lower plate of the glued sapphire plate or the upper face of the base plate of the crystal.

An independent frame of precious or semiprecious stone, for example, can also be inserted between the two sapphire plates glued to each other, as long as its thickness preferably does not exceed two-tenths of a millimeter.

In the case of quadrangular (rectangular or square) crystals, it is not necessary to glue a single plate on the base plate of the crystal. It is possible to prepare one plate extending at least into the transparent area of the crystal and opaque plates for masking the crystal fastening sockets, while forming the decoration of the visible face of the case, those different plates being perfectly juxtaposed, so as to cover the whole face of the base plate of the crystal while being glued to the latter.

As the set forming the crystal is relatively thick (which does not increase the apparent thickness of the watch, by reason of the transparency of the crystal), it is possible to hollow out rather deep seats in order to accommodate the cut diamond culet there and in which the latter can be glued, avoiding the risk of losing those stones.

Four embodiments of the watchcase are illustrated in the drawing, where:

DETAILED DESCRIPTION

The case according to the first embodiment (FIGS. 1 to 3) has the general shape of a rectangle. Its all-sapphire crystal is flat on top. It contains a base plate 2 which, in front, hides the body 3 of the case covering it entirely. A second plate 4 is permanently attached to the base plate 2 by glue 5.

Figure 1:
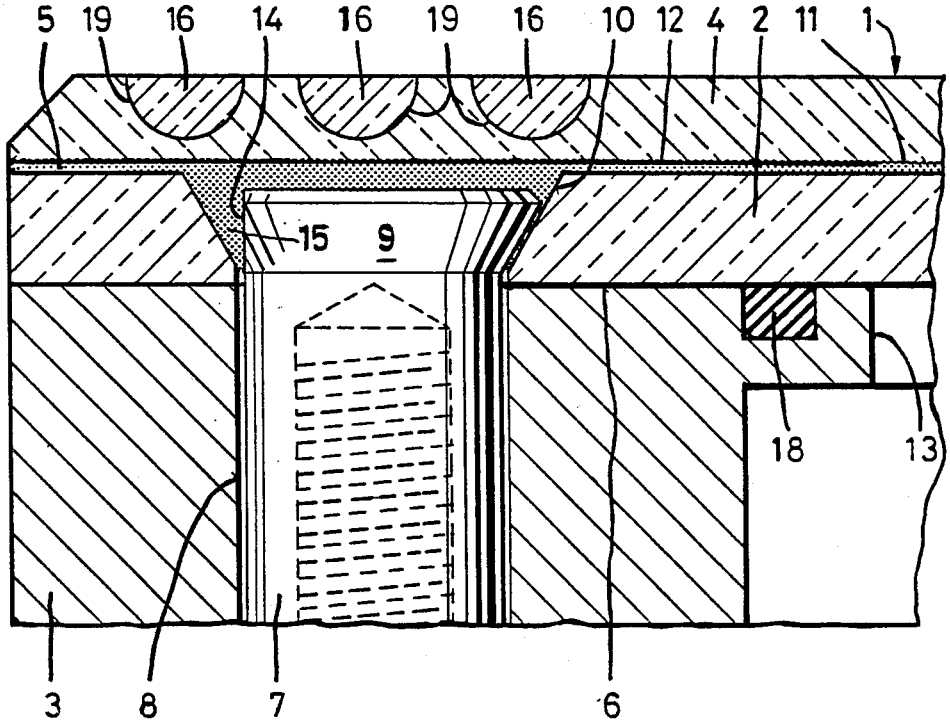
FIG. 1 is a partial sectional view of a first embodiment.

The crystal 1 rests on a flat upper surface 6 of the body 3 and is fastened to that surface 6 by four screws (not shown) engaged from the back side of the box in respective sockets 7 in the vicinity of the corners of the case, one of the screw and sockets being shown in FIG. 1. The screws and sockets 7 are located in axial holes 8 which are located across the body. In addition, those screws can be used for fastening the back of the case to the body 3, as described in Swiss patent application 2858/81-8 and 2859/81-0. In order to hold the crystal 1 in an exact position on the body 3, the diameters of the sockets 7 and holes 8 are adjusted to fit each other easily. In that way, the sockets 7 are exactly positioned on the body 3. They also are positioned in relation to the crystal 1 due to a conical head 9 formed at the rear of the sockets 7 which seats in a conical seat 10 having the same conical shape as that of the base plate 2.

If it is not possible to bore a series of cylindrical holes having constant diameter in a sapphire plate because of the very rapid wear of the boring tool, the axis of the conical seats 10 can be positioned very precisely. For the axis of the socket 7 to coincide with that of the corresponding seat 10, it is necessary for the head 9 to be well plated at the back of the respective seat 10. For that purpose, a cylindrical sleeve can be engaged on that part of each socket 7 extending under the plate 1, and then a screw whose head bears on the lower edge of corresponding sleeve can be engaged in each of those sockets. In this way, the sleeve is pressed up against the lower face of plate 2. That forces the sleeve to assume a position perfectly perpendicular to the plate 2, which it, of course, imparts to the socket 7 on which it is engaged. Furthermore, the screw pulls the head 9 down to the back of the seat 10 and firmly maintains it in that position so that its axis coincides with that of the seat 10.

For the plate 4 of the crystal then to be able to rest properly on the plate 2, it is important for the heads 9 of the sockets 7 not to project above plate 2. To satisfy that condition, the seats 10 are hollowed out to a depth slightly greater than the height of the heads 9, as shown on FIG. 1. This also reveals fine striations 11 on the other side of plate 4. That face of plate 4 is not polished but is simply ground, so that this plate has, in its dry state, the appearance of frosted glass. In that state, a fine metal coating 12 is deposited by vacuum spraying on the other side of the periphery of plate 4. That metal coating can be compact, as shown on FIG. 2. It could also consist of a first deposit of gold, for example, which could be chemically etched so as to create a decorative motif (fillets, arabesques or others) and then coated with a second protective deposit forming at the same time a ground in the etchings of the first deposit.

As the metal coating 12 is deposited on a surface of the plate 4 which has been subjected only to simple grinding, it appears dull through that plate 4.

When the sockets 7 and the above-mentioned sleeves have been fastened in the manner described to plate 2, those sleeves can serve to hold that plate in a very exact position, engaging them in corresponding holes of an appropriate placement. Once that stage is reached, the upper face of plate 2 and the lower face of plate 4 are coated with a layer of glue, such as, for example, one of those sold under the "LOCTITE" trademark, references 357 or 358, which polymerize in ten seconds under the action of ultraviolet rays, or references 317 or 318 which, on addition of an activator, polymerize in one hour at 80° C. As those glues are very fluid and moisten well, they fill the striations 11, rendering plate 4 perfectly transparent. It is, furthermore, easy to apply those glues, avoiding any air bubbles, which would adversely affect the esthetic effect of the crystal 1.

The plate 4 is then placed on plate 2 and maintained in the desired position on that plate, after which the assembly is subjected, depending on the nature of the glue, to ultraviolet radiation or to heat. That operation produces polymerization of the glue to the point of generating an adherence of several kgp/mm$^2$. However, only the glue set between plates 2 and 4, excluding the "overflow" oozing around those plates, undergoes the polymerization described. The beads of glue around those plates remain soft and can be removed without difficulty.

It is to be noted on FIG. 1 that the metal coating 12 extends from the edge of plate 4 toward the inside, up to slightly beyond the opening 13 of the square 3, in which the dial (not shown) of the watch is intended to appear. As the striations 11 have been filled with glue, the area of the crystal inside the metal coating 12 is perfectly transparent. Furthermore, that zone of the crystal is anti-reflecting. This is advantageous in that the dial no longer needs to be subjected to laborious operations intended to make its surface dull. FIG. 1 also shows that the layer of glue 5 extends not only throughout the space between the adjacent flat faces of plates 2 and 4, but also fills the spaces of the conical holes 10 of plate 2 that the heads 9 of the sockets 7 leave open.

In order to prevent the sockets 7 from turning in relation to the crystal 1, when the latter is screwed on the body 3, at least one flat 14, but preferably two (FIGS. 2 and 3), are formed on the head 9 of each socket 7, so that the glue forms packings 15 between those flats 14 and the seats 10.

Figure 2:
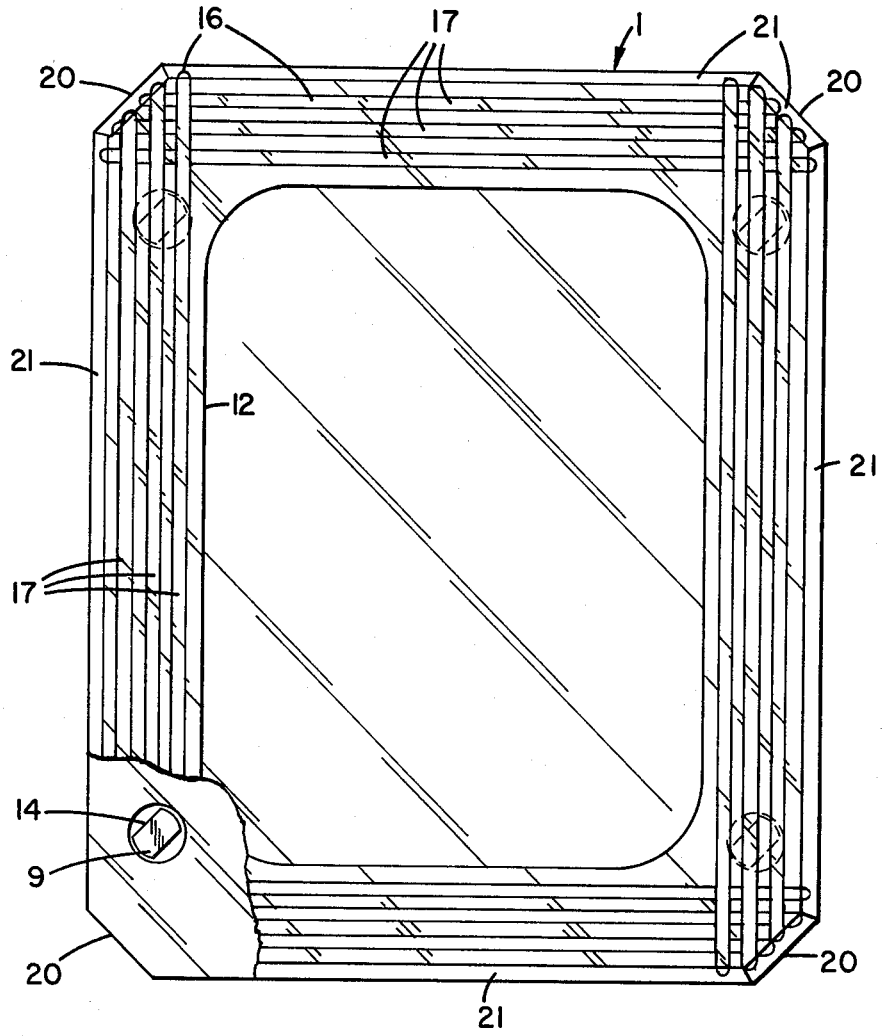
FIG. 2 is a plan view on a smaller scale of the first embodiment with a portion being broken away.

FIGS. 1 and 2 show that plate 4 carries, along each of its sides, above the metal coating 12, three semicylindrical baguettes 16, which are glued in grooves of the same shape formed in plate 4. Those baguettes may be made of corundum or colored sapphire, that is, of the same base material as plates 2 and 4. A reflective metal coating is deposited on their cylindrical face, so that the incident light is reflected into a narrow median zone of those baguettes, where it forms a line of intense luminosity 17 (FIG. 2).

Finally, the tightness of the joint between the crystal 1 and the body 3 is assured by a gasket 18 lodged in a groove machined in the face 6 of the body 3.

Figure 3:
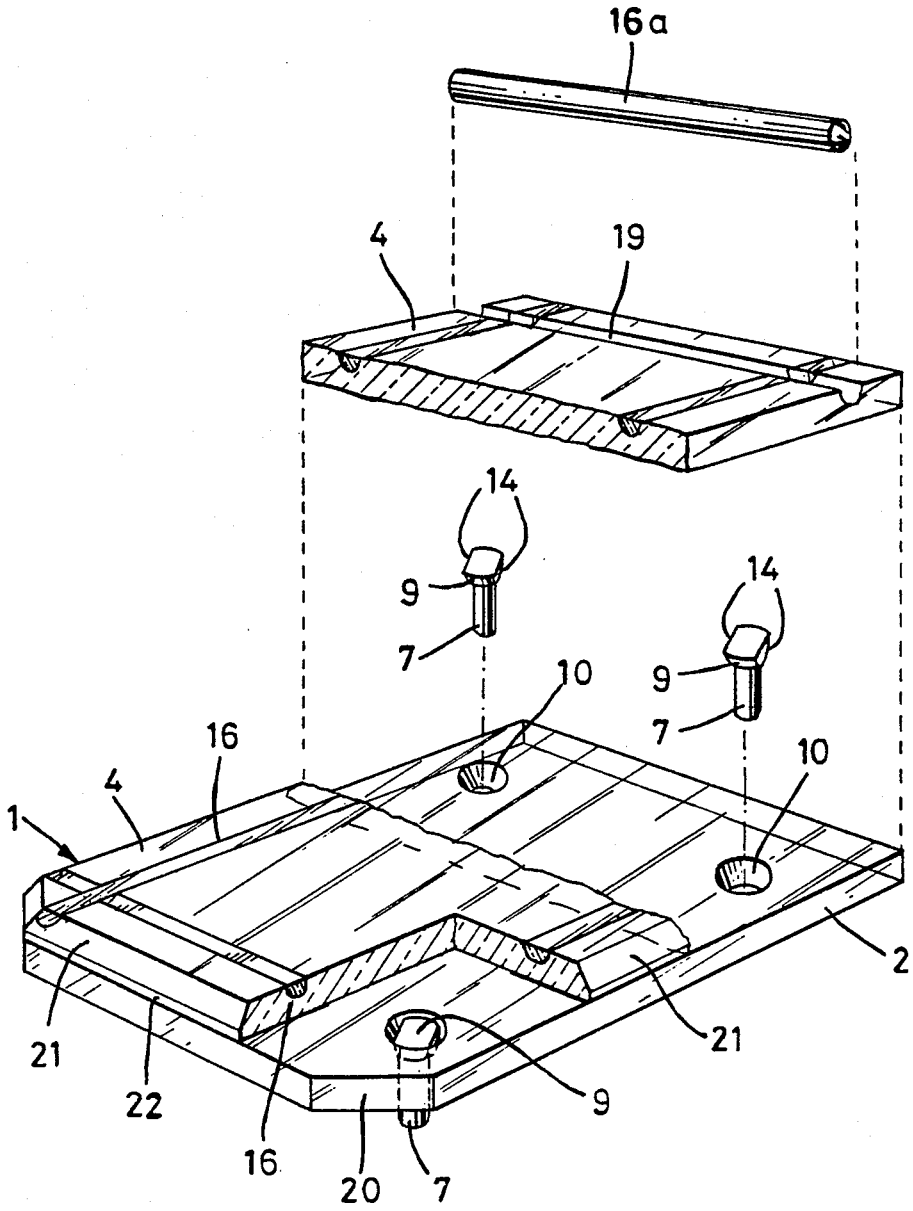
FIG. 3 is an exploded perspective view of the crystal with some portions being segmented.

FIG. 3 shows how crystal 1 is produced where only one baguette 16 per side of the crystal has been shown for greater simplicity. In the righthand part of that figure, it can be seen that in the beginning sapphire plates 2 and 4 are perfectly rectangular. Their corners are sharp and their edges perpendicular to the faces. Semicylindrical grooves 19, in a number equal to that of the baguettes 16 to be incorporated in the crystal, are hollowed out from one edge of plate 4 to the other. At the outset, those colored sapphire baguettes are cylindrical, as shown at **16*a* in FIG. 3. Their fabrication is easy and inexpensive. The cylindrical face of the baguettes 16*a* is polished and then covered with a reflective metal coating. Those baguettes 16*a* are glued in the grooves 19 of plate 4, and then their portion projecting from that plate is eliminated by grinding, so as to bring the ground face of those baguettes flush with the upper face of plate 4, which can then be polished at the same time as the uncovered face of the baguettes 16. Those operations can result in a reduction of thickness of that plate and, therefore, of the width of the grooves 19 and baguettes 16, to the extent that they will no longer have only the shape of a circular segment. Although that reduction does not appreciably influence the esthetic effect of the baguettes 16, it is, nevertheless, advisable not to push it to the point of impairing the adhesion of those baguettes to the bottom of the grooves 19. After having subjected the other side of plate 4 to the metal coating described, that plate can be glued on plate 2**.

It is, however, possible to hollow out the grooves 19, to glue the baguettes **16*a* there, to grind them and then to polish the upper face of plate 4 after its gluing to plate 2**.

The crystal thus obtained is then cornered, as shown at 20 on FIG. 2, and bezels 21 are formed all around the upper edge of the crystal, the flanges 22 of which can be polished at that time. The length of the baguettes **16*a* is chosen so that their ends are bezeled at the same time as plate 4, It is also to be noted on FIG. 2 that the baguettes 16*a*, extending along the short sides of the crystal are glued in place before hollowing out the grooves 19 along the long sides of plate 4. Thus, the baguettes 16*a* last glued are fitted without a gap in the hollowed parts of the baguettes already glued along the short sides of plate 4**.

Although the heads 9 of the sockets 7 are inside the crystal 1 itself, the ornaments 12, 16 do not just conceal those sockets; they give the visible face of the case a highly original appearance.

Instead of allowing the striations 11 on the lower face of plate 4 to remain, they could also be left on the upper face of base plate 2. The glue would affect them in the same way. The center part of the crystal would also be perfectly transparent and the same anti-reflecting effect would be obtained. As the metal coating 12 would be deposited on a polished surface, it would, however, appear bright.

Since the two sapphire plates 2,4 are very solidly joined to each other in the transparent area of the crystal 1, it is unnecessary for the metal coating 12 to adhere particularly well to the plate 4. As the coating 12 is captured between those two plates, which protects it, one could very well deposit there, for example, a silver or aluminum coating, the relatively reduced adherence of which barred its use in all prior cases where the coating is exposed, even though its appearance is both attractive and original.

If, after chemical etching of a first deposit on the other side of plate 4, the metal coating 12 gives the crystal 1 and, consequently, the case an already decorative enough appearance, any other ornamental addition to plate 4 may not be desired.

Figure 4:
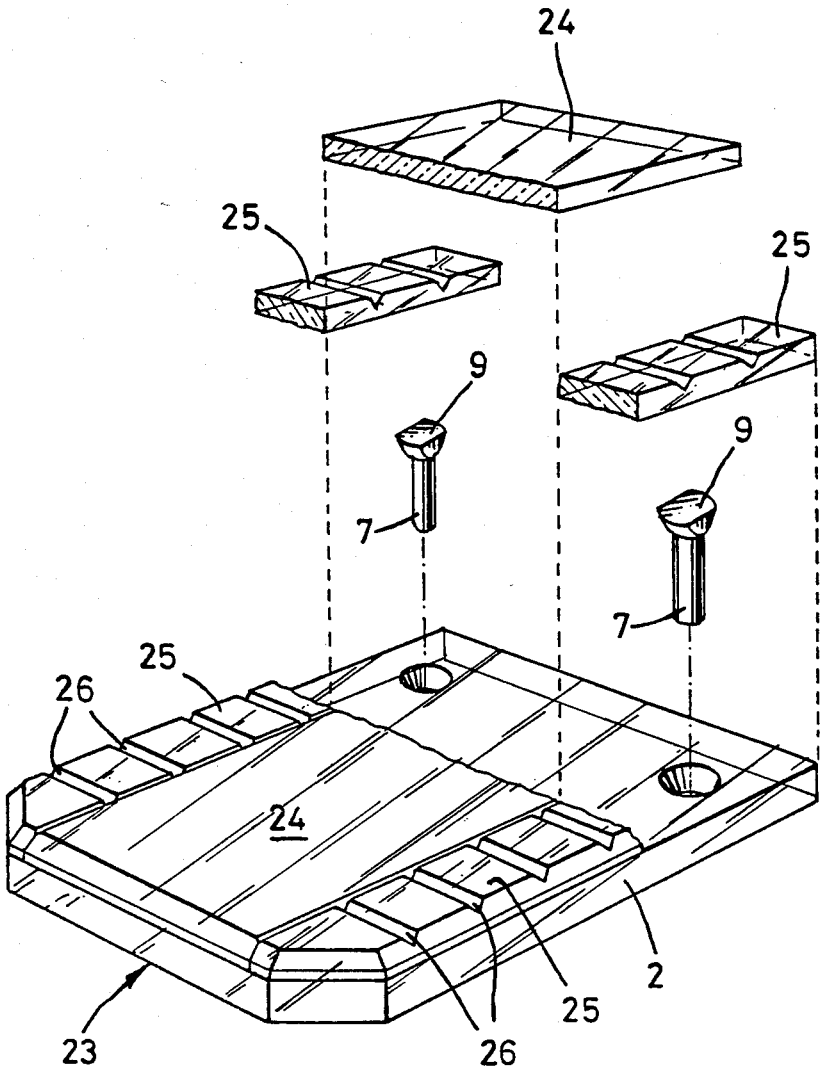
FIG. 4 is a view similar to that of FIG. 3, illustrating a second embodiment of the invention.

A second embodiment of the invention differs from the first one only in its crystal shown in FIG. 4. This crystal contains a base plate 2, identical to that of the first embodiment. The sockets 7 are previously fastened to it in the same way. In this case, the base plate is not covered with just one, but with three sapphire plates 24, 25, with plate 24 covering the median part of plate 2 while plates 25 extend along the long sides of plate 2. Plate 24 and both plates 25, which have the same thickness, are perfectly juxtaposed and entirely cover plate 2. The two end zones of plate 24, intended to extend above the body of the case, are decoratively opaqued, as in the first embodiment. As for plates 25, they are entirely opaque and mask the heads 9 of the sockets 7. They can be colored sapphire or carry a metal coating on the other side. In addition, V-shaped notches are hollowed out through plates 25. As this hollowing produces notches with flared edges, they are formed in thicker plates and then the extra thickness is eliminated by grinding, after the gluing of plates 25 on the base plate 2, in order to obtain notches 26 with free edges, the flanges of which constitute reflecting facets, producing a decorative effect.

Instead of and in addition to little plates 25, similar plates could also be glued along the short sides of plate 24, the latter being made shorter and possibly wider, so that the set of little plates glued on the base plate 2 always covers the latter entirely without projecting while masking the heads 9 of the sockets 7.

Figure 5:
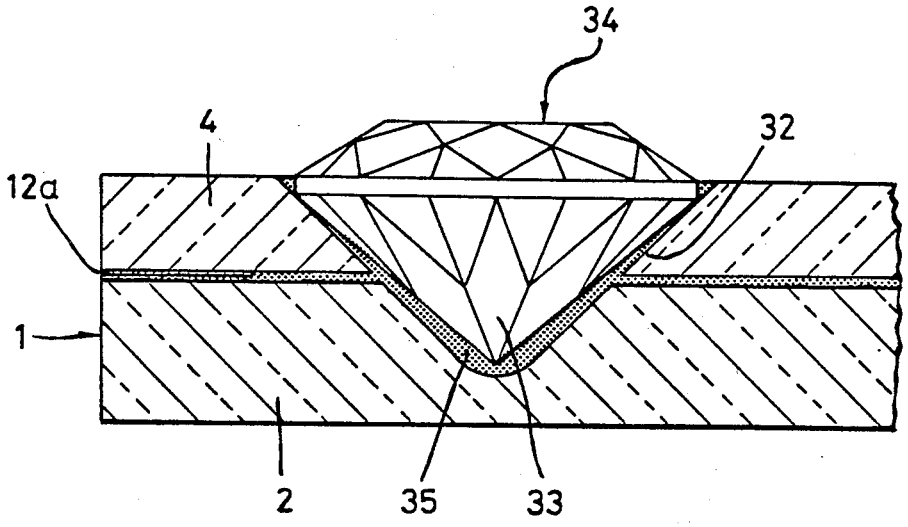
FIG. 5 is a partial sectional view of a detail of a third embodiment.

In a third embodiment of the invention (FIG. 5), the metal coating, provided in the first embodiment to mask the upper face of the body of the case and the bases of the crystal fastening socket is replaced by a frame of metal for precious or semiprecious stone 12*a* in one or more pieces which is glued under plate 4. For the glue to set properly in the transparent area of the crystal, it is important, however, for that frame to be thin enough. Preferably, its thickness will not exceed two-tenths of a millimeter. That way of opaquing the periphery of the crystal is obviously also applicable in the first two embodiments. It is clear that such a frame is protected in the same way as the metal coating described. Even when made of very soft metal, it then gives the case an inalterable appearance.

Instead of the baguettes 16 of the first embodiment, one or more cut diamonds may be set in the crystal in this third embodiment. For each diamond, a conical seating is hollowed out for that purpose through plate 4, as far as a part of base plate 2. As those seatings 32 do not cross the crystal, they do not impair its tightness. Furthermore, the resulting weakening of the crystal is negligible. The culet 33 of a cut diamond 34 is then glued in each of the seats 32. The adherence of the glue 35 eliminates any risk of losing the brilliants 34. Furthermore, a brilliant set in that way provides more of an effect than if it were set in a metal seating, for it receives light from everywhere through the sapphire of the crystal and the glue 35, which is perfectly transparent.

Figure 6:
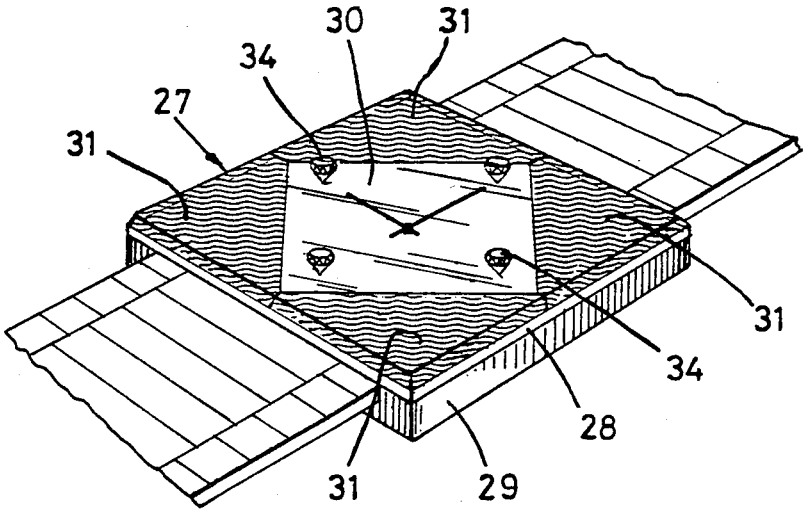
FIG. 6 is a perspective view of a fourth embodiment.

A fourth embodiment (FIG. 6) is distinguished from the preceding ones, first, by the shape of the case, which is square. The crystal 27 of this embodiment also contains a base plate 28, which is square and entirely covers the upper face of the body 29. A square center plate 30, entirely transparent, and four plates 31, opaque or opaqued in the same way as in the previous embodiments and generally triangular in shape, are glued on the base plate 28, so as to cover it entirely, without projecting while masking the upper face of the body 29 and the bases of the sockets (not represented) fastening the crystal 27 to the square 29.

In addition, four diamonds 34 are set in the crystal 27 in the vicinity of the corners of the plate 30, in the manner described in the third embodiment. Instead of marking hour signs, as is the case in this embodiment, the brilliants could obviously be set elsewhere in the watch crystal, e.g. at the corners of the case.

While several embodiments of this invention have been set forth others may become apparent to those skilled in the art. Such variations are contemplated to be within the scope of protection afforded by this patent application.

What is claimed is:

1. For a wristwatch case having a flat sapphire crystal which masks the body of the case covering it entirely, and is fastened to the body by screws engaged from its back side in sockets integrated with the crystal, an improvement comprising each socket comprising a head firmly captured inside the crystal, said crystal formed of two sapphire plates glued to each other, said head captured between said two sapphire plates, said heads being masked by ornaments incorporated in the crystal.

2. An improvement according to claim 1, wherein said crystal comprises a base plate occupying its entire surface, wherein openings are bored through said base plate for each of the said sockets, a portion of said openings being formed in said base plate, said portion being conical in shape, said heads of said sockets comprising the same conical shape as said portions and having a height no greater than the conical portion of said openings, so that said heads are sunk within the base plate of the crystal.

3. An improvement according to claim 2, wherein a single sapphire plate is glued to said base plate of the crystal which it entirely covers without projecting from the base plate, and said ornaments comprise a metal coating formed by vacuum spraying on the other side of the peripheral zone of said single sapphire plate.

4. An improvement according to claim 3, wherein said ornaments further comprise colored sapphire baguettes which have a circular segment-shape, said crystal having grooves formed on the external face thereof, said baguettes being glued with insertion of a metal coating, formed by vacuum spraying in said grooves, said grooves having a sectional shape corresponding to the shape of said baguettes, said baguettes being flush with said external face.

5. An improvement according to claim 3, wherein one of the faces of said plates of the crystal which is to be glued to the other plate is ground and presents fine striations.

6. An improvement according to claim 4, wherein one of the faces of said plates of the crystal which is to be glued to the other plate is ground and presents fine striations.

7. An improvement according to claim 2, wherein a single sapphire plate is glued to the base plate of the crystal which it entirely covers, wherein said ornaments include a thin frame in one or more juxtaposed decorative pieces, said frame being inserted between said plates of the crystal and integrated with them by gluing.

8. An improvement according to claim 2, wherein said crystal has a quadrangular shape and a set of juxtaposed plates of the same height form a center sapphire plate which extends at least to the whole transparent area of the crystal, said set of juxtaposed plates being glued on the said base plate to cover it entirely without projecting from it.

9. An improvement according to claim 2, wherein said ornaments include at least one brilliant which is glued in a conical seat, hollowed out through a glued sapphire plate into a part of said base plate.

* * * * *